United States Patent [19]

Krautzberger et al.

[11] Patent Number: 4,470,442

[45] Date of Patent: Sep. 11, 1984

[54] ROTARY CUTTER FOR WOOD CUTTING MACHINE, AND DEVICE FOR HOLDING CUTTING ELEMENTS THEREOF

[75] Inventors: Dieter Krautzberger; Harro Kröcher, both of Bad Kreuznach; Arnold Schmidt, Gutenberg, all of Fed. Rep. of Germany

[73] Assignee: Hombak Maschinenfabrik GmbH u. Co. KG., Bad Kreuznach, Fed. Rep. of Germany

[21] Appl. No.: 376,830

[22] Filed: May 10, 1982

[30] Foreign Application Priority Data

May 21, 1981 [DE] Fed. Rep. of Germany ..... 3120249

[51] Int. Cl.[3] ..... B27G 13/04

[52] U.S. Cl. ..... 144/230; 144/42; 144/172; 241/294; 407/45; 407/50; 407/100

[58] Field of Search ..... 144/39, 42, 162 R, 230; 241/294, 277, 292, 286, 300, 300.1; 407/37–39, 45, 44, 49, 50, 94–96

[56] References Cited

U.S. PATENT DOCUMENTS 4,068,694 1/1978 Schmidt et al. ..... 144/230

4,194,545 3/1980 Kostermeier ..... 144/230

4,405,092 9/1983 Sybertz et al. ..... 241/294

*Primary Examiner*—W. D. Bray

*Assistant Examiner*—Jorji M. Griffin

*Attorney, Agent, or Firm*—Michael J. Striker

[57] ABSTRACT

A holding device for a rotary cutter has a supporting member extending over a greater part of each cutting element and having a web and holding tongues provided with an openings for receiving tightening screws, an abutment surface for abutting the cutting element and determining a projecting length of the latter, a wearing member fixed in the body part for abutment of the rear surface of the cutting element, a locking member for fixing the wearing member, a centrifuging wedge member with a wedge surface pressing the cutting element against the wearing member, wherein the wearing member has a locking groove which is open toward the cutting element and forms the abutment surface and in which the web of the supporting member is received in a form locking manner, and the centrifuging wedge member lies with its wedge surface directly against the front surface of the cutting element.

8 Claims, 5 Drawing Figures

Fig.1
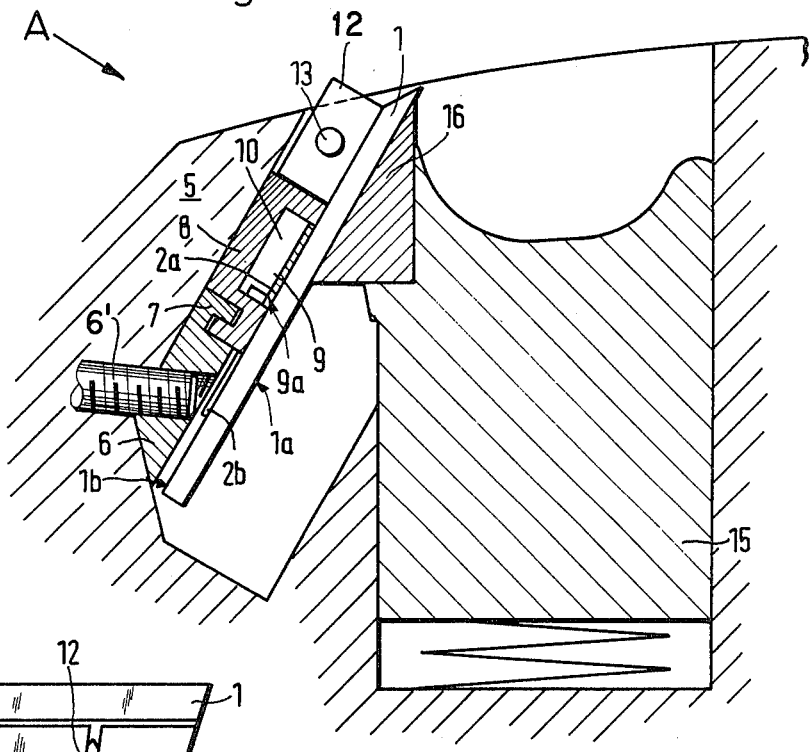
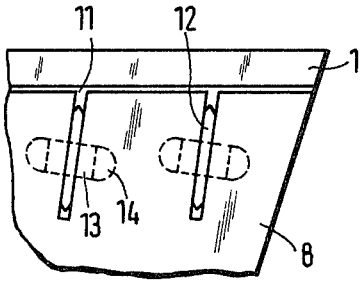
Fig.2
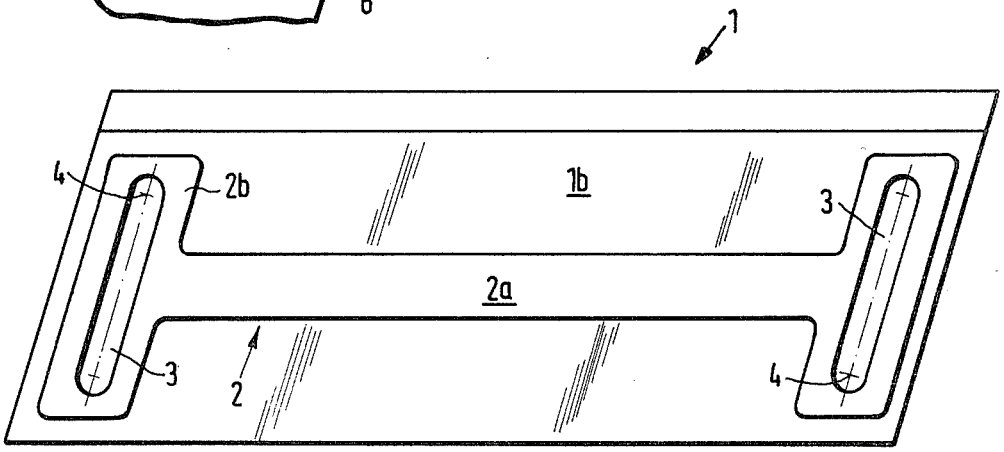
Fig.3

ROTARY CUTTER FOR WOOD CUTTING MACHINE, AND DEVICE FOR HOLDING CUTTING ELEMENTS THEREOF

BACKGROUND OF THE INVENTION

The present invention relates to a holding device for mounting a resharpenable cutting element in a rotary cutter of a wood cutting machine, as well as to a rotary cutter of the latter.

Rotary cutters and holding devices of the above-mentioned general type are known in the art. A known holding device has a supporting member extending over a greater part of the length of the cutting element and having a web which is small as compared with the height of the cutting element and provided with holding tongues extending over a part of the side of the cutting element and having elongated openings. Tightening screws extend through these openings so that the supporting member can displace somewhat radially over the rear surface of the cutting element and be fixed. An abutment surface fixedly arranged in the body part of the cutter determines a projecting length of the cutting element and is located so that the supporting member loosely lies against the same. A wearing member is fixed in the body part of the cutter via a somewhat radially acting locking member and arranged so that the cutting element abuts with its rear surface against the wearing member. Finally, a centrifuging wedge member presses against the wearing member. Such a rotary cutter and its holding device is disclosed, for example, in the German Gebrauchsmuster No. 8,002,428. The cutting element lies with its front surface loosely against a clamping strip which is held in the body part via a locking member and is actuated by a centrifuging wedge member which presses the clamping strip against the front surface of the cutting element and thereby the cutting element against the wearing member. The cutting element is loosely introduced, together with supporting member screwed therewith, into an approximately radially extending insertion slot of the wearing member and abuts with assured abutting face of the supporting member loosely against the above-mentioned abutment surface in the body part of the cutter. In the above-described known construction, the cutting element is thereby held exclusively in a force transmitting manner. In order to prevent that the centrifugal wedge member which is pulled radially outwardly under the action of the centrifugal force changes the position of the cutting element in the cutter body and thereby the projecting length of the cutting element over the outer surface of the body part, the clamping strip between the centrifuging wedge member and the front surface of the cutting element which is form lockingly fixed in the body part is provided. The abutment surface which supports the supporting member is formed as a holding strip which is screwed with the body part and located, as seen in radial direction, under the cutting element as well as the supporting element. A peripheral recess provided in the body part for receiving the holding device must therefore be deeper than the width of the cutting element in order to additionally receive the above-mentioned holding strip.

SUMMARY OF THE INVENTION

Accordingly, it is an object of the present invention to provide a rotary cutter and a holding device therefor, which avoid the disadvantages of the prior art.

More particularly, it is an object of the present invention to provide a rotary cutter and a holding device which have a simpler construction .

In keeping with these objects, and with others which will become apparent hereinafter, one feature of the present invention resides, briefly stated, in a holding device in which a wearing member has a locking groove which opens toward a cutting element and forms an abutment surface, so that a web of a supporting member for the cutting element is inserted in the locking groove in a form-locking manner, and the centrifuging wedge member lies with its wedge surface directly against a front surface of the cutting element.

The form-locking connection which was provided in the prior art for the clamping strip is formed in accordance with the invention behind the rear surface of the cutting elements between the supporting member and the wearing member. The supporting member of the cutting element and thereby also the cutting element screwed therewith are held directly in a form-locking manner in the wearing member. The cutting element is also secured in a radial direction from displacement. Because of this it is possible in accordance with the invention to dispense with the clamping strip which was used in the prior-art construction and provide abutment of the centrifugal wedge member directly against the front surface of the cutting element. The inventive holding device is composed of a small number of parts. Because of the absence of the clamping strip for the cutting element, its locking member and holding strip are also dispensed with, and there is a possibility that the locking member which holds the wearing member in the body part is located completely behind the rear surface of the cutting element. For this purpose the peripheral recess which receives the holding device can be formed only with such a depth which is required for receiving the cutting element. There are no more parts which overlap the cutting element. The locking member which holds the wearing member can be formed in conventional manner hook-shaped and formed by a holding strip screwed with the body part of the cutter or fixed in any other way.

In accordance with another advantageous of the present invention, a permanent magnet is arranged in the locking zone of the wearing member so that the web of the supporting member abuts against the permanent magnet. Thereby, the cutting element, the supporting member and the wearing member are inserted into or removed from the body part of the cutter as a set. At the same time, the cutting element which is screwed with the supporting member can be easily separated from the wearing member, for example for sharpening of the cutting element. During grinding process the assembly of the cutting element and the supporting member remains maintained. The setting of the sharply ground cutting element is performed by a special setting device, wherein the web of the supporting member forms a reference edge. For setting, the tightening screws are somewhat released and after the adjustment of the cutting element are again fixedly tightened.

In accordance with yet another advantageous feature, the centrifugal wedge member abuts against the front surface of the cutting element via a releasably connectable wearing strip. The wearing strip is independent of the length of the produced chips can be easily exchanged.

The holding device in accordance with the present invention is basically suitable for a tooth (comb) cutter or so-called double tooth (comb) cutter; however, it is also suitable for a cutter with a throughgoing cutter edge. In this case, the wearing member may be provided with an insertion slot in which rectangular scratcher plates are inserted in a form-locking manner and retained by the cutter element. Each scratcher plate has a pin extending beyond both sides of the former and engaging in an insertion groove of the wearing member, the groove being opened toward the cutting element.

The holding device in accordance with the present invention is also designed for switching from the tooth cutters to cutters with throughgoing cutting edges. The new holding device provides for a high adjustment accuracy for the cutting element and leads to lower additional costs for grinding of the cutting element. The wearing member arranged behind the cutting element can simultaneously serve as a scratcher support.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view showing a section of a rotary cutter with a holding device for cutting elements;

FIG. 2 is a fragment of a plan view of the inventive holding device as seen in direction A in FIG. 1;

FIG. 3 is a plan view of a rear surface of a cutting element connected with a supporting member and, FIGS. 4 and 5 are perspective views illustrating parts of FIGS. 1 and 3.

DESCRIPTION OF A PREFERRED EMBODIMENT

Figure 5:
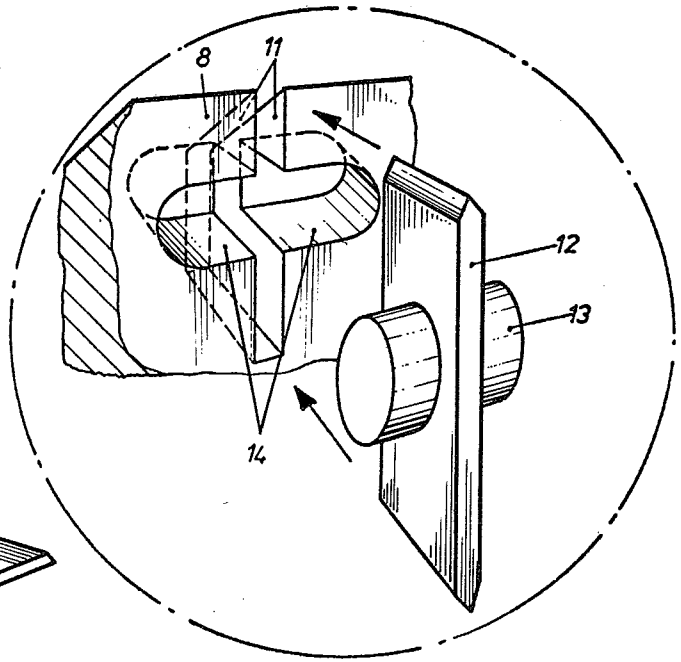
Figure 4:
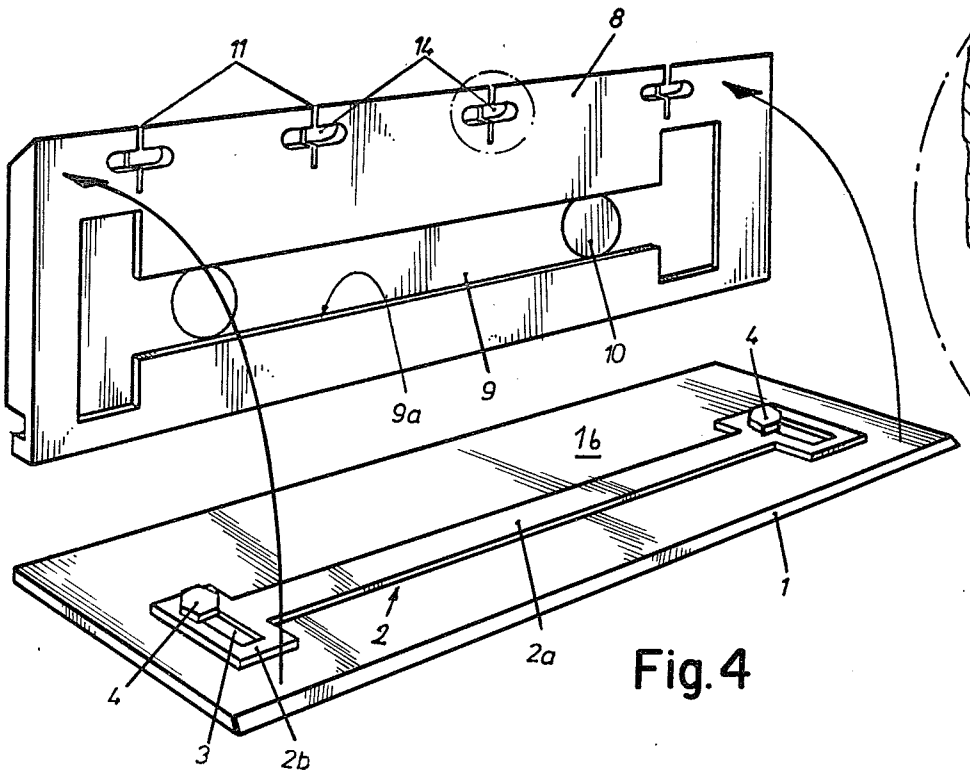

A rotary cutter and a holding device for holding a plurality of cutting elements in a body of the rotary cutter is shown in the drawing, wherein one of the cutting elements is illustrated and identified by reference numeral 1. The cutting element 1 has in the shown embodiment a throughgoing (uninterrupted) cutting edge.

The holding device includes a supporting member identified by reference numeral 2 and extending over a greater part of the length of the cutting element. It has a web 2*a* which is small as compared with the height of the cutting element and is provided with holding tongues 2*b*. The tongues extend over a part of the height of the cutting element and has elongated openings 3, as can be seen from FIG. 3. Tightening screws 4 extend through the elongated openings 3 so that the supporting member is displaceable over a rear surface 1*b* of the cutting element 1 substantially in radial direction and fixable.

A holding member 6 is screwed by a screw 6' in a body 5 of the cutter and has a hook-shaped locking part 7. A wearing member 8 engages in the locking part 7. The cutting element 1 abuts with its rear surface 1*b* against the wearing member 8. The wearing member 8 has a locking groove 9 which opens toward the cutting element 1. The web 2*a* of the supporting member 2 is inserted into the locking groove 9 in a form-locking manner. The term "form-locking" is utilized here to identify an interengaging connection in which shapes of respective members complement each other.

The locking groove 9 forms an abutment surface 9*a* for the web 2*a* of the supporting member 2 and thereby determines a projecting length of the cutting edge of the cutting element beyond the outer surface of the body part of the cutter. A permanent magnet 10 is arranged in the locking groove 9. The above-mentioned web 2*a* of the supporting member 2 freely abuts against the permanent magnet 10.

The wearing member 8 has moreover insertion slots 11. Rectangular chip breakers 12 are inserted in the insertion slots 11 in a form locking manner. The chip breakers 12 are retained in the insertion slots 11 by the cutter 1. Each scratcher plate 12 has a pin 13 extending outwardly beyond the same at both its sides. The wearing member 8 has, on the other hand, insertion grooves 14 which are open toward the cutting element 1. The above-mentioned pins 13 engage in the insertion grooves 14, as can be seen from FIG. 2.

The holding device further has a centrifuging wedge member 15 which lies against a front surface 1*a* of the cutting element 1 via a wearing strip 16 releasably connected with the centrifugal wedge member 15. The centrifugal wedge member 15 presses the cutting element 1 with its rear surface 1*b* against the wearing member 8. The wearing strip 16 of the centrifuging wedge member 15 is formed wedge-shaped in its region which faces toward the cutting edge of the cutting element 1.

It will be understood that each of the elements described above, or two or more together, may also find a useful application in other types of constructions differing from the types described above.

While the invention has been illustrated and described as embodied in a rotary cutter and a holding device therefor, it is not intended to be limited to the details shown, since various modifications and structural changes may be made without departing in any way from the spirit of the present invention .

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of the present invention.

What is claimed as new and desired to be protected by Letters Patent is set forth in the appended claims:

1. A rotary cutter, comprising a rotary body part having an axis;

a plurality of cutting elements radially arranged in said body part and each having a cutting edge, predetermined height and length, and front and rear surfaces;

a supporting member provided for each of said cutting elements, transversely movable relative to said cutting elements and extending over a greater part of said cutting element, said supporting member having a web which is small relative to the height of said cutting element and provided with holding tongues, said holding tongues extending transversely over a part of the height of said cutting element and having elongated openings;

tightening screws extending through said openings of said tongues of said web of said supporting member so that said supporting member can be fixed;

an abutment surface for each of said cutting element and arranged fixedly on said body part so that a respective one of said cutting elements loosely abuts against said abutment surface and the latter determines a length by which said cutting element projects radially outwardly beyond said body part;

a wearing element for each of said cutting element and fixed in said body part so that a respective one of said cutting elements abuts with its rear surface against said wearing member;

a locking member arranged for fixing a respective one of said wearing member is said body part; and a centifuging wedge member having a wedge surface and pressing a respective one of said cutting elements against its associated wearing member, said wearing member having a locking groove which is open toward said cutting element and forms said abutment surface and in which said web of said supporting member is received in a form-locking manner, and said centifuging wedge member lying with its wedge surface directly against said front surface of a respective one of said cutting elements.

2. A rotary cutter as defined in claim 1; wherein said locking member which holds said wearing member in said body part lies completely behind said rear surface of said cutting element.

3. A rotary cutter as defined in claim 1; and further comprising a permanent magnet arranged in said locking groove so that said web of said supporting member abuts against said permanent magnet.

4. A rotary cutter as defined in claim 1; and further comprising a wearing strip releasably connectable with said centifuging wedge member, said centifuging wedge member lying against said front surface of said cutting element via said wearing strip.

5. A rotary cutter as defined in claim 4; wherein said wearing strip of said centrifuging wedge member has a region facing toward said cutting edge of said cutting element and being wedge-shaped.

6. A rotary cutter as defined in claim 1; wherein said wearing member has an insertion slot; and further comprising a rectangular chip breaker member inserted in said insertion slot in a form-locking manner said chip breaker member being held by said cutting element.

7. A rotary cutter as defined in claim 6; wherein said wearing member has an insertion groove open toward said cutting element, each of said scratcher plate member having a pin extending beyond the former at its both sides and engaging in said insertion groove.

8. A holding device for mounting in a rotary cutter with a body part having an axis a plurality of cutting elements radially arranged in the body part and each having a cutting edge, predeteremined height and length, and front and rear surfaces, the holding device comprising a supporting member provided for each of the cutting elements, transversely movable relative to the cutting elements and extending over a greater part of the cutting element, and supporting member having a web which is small relative to the height of the cutting element and provided with holding tongues, said holding tongues extending transversely over a part of the height of the cutting element and having elongated openings;

tightening screws extending through said openings of said tongues of said web of said supporting member so that said supporting member can be fixed;

an abutment surface for each of the cutting elements and arranged fixedly on the body part so that a respective one of the cutting elements releasably abuts against said abutment surface and the latter determines a lengeth by which the cutting element projects radially outwardly beyond the body part;

a wearing member for each of the cutting elements and fixed in the body part so that a respective one of the cutting elements abuts with its roar surface against said wearing member;

a locking member arranged for fixing a respective one of said wearing members in the body part;

a centifuging member having a wedge surface and pressing a respective one of the cutting elements against its associated wearing member, said wearing member having a locking groove which is open toward the cutting element and forms said abutment surface and in which said web of said supporting member is received in a form-locking manner, and said centifuging member lying with its wedge surface directly against the front surface of a respective one of the cutting elements.

* * * * *